US005150419A

United States Patent [19]

Kizak et al.

[11] Patent Number: 5,150,419

[45] Date of Patent: Sep. 22, 1992

[54] CALOTTE-TYPE TREBLE LOUDSPEAKER

[75] Inventors: Ulrich Kizak, Niederwinkling; Kurt Leipold, Feldkirchen, both of Fed. Rep. of Germany

[73] Assignee: Nokia Unterhaltungselektronik GmbH, Pforzheim, Fed. Rep. of Germany

[21] Appl. No.: 762,893

[22] Filed: Sep. 19, 1991

[30] Foreign Application Priority Data

Oct. 6, 1990 [DE] Fed. Rep. of Germany ..... 4031742

[51] Int. Cl.[5] ..... H04R 25/00

[52] U.S. Cl. ..... 381/194; 381/192; 381/199

[58] Field of Search ..... 381/192, 193, 194, 199, 381/201

[56] References Cited

U.S. PATENT DOCUMENTS 3,358,089 12/1967 Parker ..... 381/199

4,421,956 12/1983 O'Neill ..... 381/201

4,565,905 1/1986 Nation ..... 381/194

*Primary Examiner*—Jin F. Ng

*Assistant Examiner*—Huyen D. Le

*Attorney, Agent, or Firm*—Ware, Fressola, Van Der Sluys & Adolpshon

[57] ABSTRACT

The invention specifies a calotte-type (encased) loudspeaker distinguished by very small dimensions. The pot magnet (12) is joined to a single-piece case component (11) exclusively by means of elastic snap catches (32) such that a terminal locking hook (35) forming an integral part of the said snap catches (32) engages with a collar (25) arranged on the pot magnet (12). After the case component (11) and the pot magnet (12) have been joined together, the membrane (21) is kept in position between the case component (11) and the pot magnet (12) exclusively by virtue of the fact that the part of the membrane (21) that bears against the pot magnet (12) is pressed against the said pot magnet (12) by the free end (29) of the piece of tubing (28) attached to the case component (11).

2 Claims, 2 Drawing Sheets

CALOTTE-TYPE TREBLE LOUDSPEAKER

TECHNICAL FIELD

The present invention is concerned with the size reduction of calotte-type treble loudspeakers.

STATE OF THE ART

Such calotte-type (or encased) loudspeakers have been known in the state of the art for a long time and are employed in large numbers wherever high-frequency sound signals have to be reproduced. The common feature of these known loudspeakers is that they comprise a pot magnet with a pole core arranged concentrically inside the said pot magnet and at a certain distance from its internal face. Into this gap between the pole core and the internal face of the pot magnet there projects the moving coil. The end of the moving coil facing away from the pot magnet is connected to a membrane having a roughly hemispherical shape. A special centering membrane is also provided to keep the moving coil properly centered with respect to the pole core. As a general rule, moreover, the membrane and the centering membrane are designed as a one-piece component. The pot magnet is connected to a case that extends to cover the membrane and the centering membrane on the side facing away from the pot magnet. The membrane is normally glued into the case component. The connection between the pot magnet and the case component is traditionally realised as a glued joint. With a view to improving the tone, the case component may also be provided with acoustic equalizers in the area of the openings permitting the sound to pass.

When such loudspeakers are to be used for the transmission of high-frequency sound, they usually have a membrane diameter and/or a moving coil diameter of the order of 19 to 25 millimeters (in this connection see, for example, the review "Funkschau" 1983, No.7, pp.99 and 100). If acceptable sound reproduction is to be obtained, these diameters call for a correspondingly large pot magnet with outer diameters in the range from about 35 to 45 millimeters. When such a calotte-type treble loudspeaker is to be reduced in size to permit it to be installed even in very limited spaces, this cannot be done by mere reduction of the diameter of the moving coil and the pot magnet. This is due to the fact that the diameter of the pot magnet cannot be reduced in full proportion to the reduction in the moving coil diameter. Some improvement is obtained when the pole core is made at least partly of a high energy material. In this connection it must be pointed out, however, that even when the pole core is designed in this special manner, the loudspeaker may still be too big for really tight installation conditions. This is due to the fact that the edge of the membrane available for gluing it to the loudspeaker case must be relatively wide if an adequate glued bond is to be obtained. But even if one takes no account of the effect of the width of the gluing edge on the size of the loudspeaker, it has been found that loudspeakers of a traditional structure with a moving coil diameter of less than 19 mm suffer from a rapidly diminishing efficiency.

The present invention is therefore underlain by the problem of specifying a calotte-type treble loudspeaker with an outer diameter of the pot magnet less than or equal to 25 mm that will yet retain a good efficiency.

DESCRIPTION OF THE INVENTION

This problem is solved by making the diameter of the moving coil smaller than 19 mm, connecting the case component to the pot magnet exclusively by means of elastic snap catches arranged around the edge of the case component, where the terminal hook of the said catches engages with an appropriate collar or projection provided on the outer surface of the pot magnet, and by arranging matters in such a way that the single-piece membrane, following attachment of the case to the pot magnet, will be maintained in position solely by virtue of the fact that the part of the membrane in contact with the pot magnet is pressed against the said pot magnet by means of the free end of a piece of tubing attached to the case component.

When calotte-type treble loudspeakers are designed in accordance with the present invention, their small overall size makes it possible for them to be combined with another loudspeaker to form a coaxial loudspeaker array and thus to obtain further space savings.

When the pot magnet and the case component are solidly connected together by means of elastic snap catches, this has the further advantage that the waiting periods caused by he hardening of the glue can be avoided.

When—as specified in claim 2—jointing or alignment aids are arranged on the outer surface of the pot magnet and the inner surface of the case component, in either case on the part where the two components overlap, this has the advantage of ensuring that the pot magnet will always be inserted into its correct position in the case component or, vice-versa, the case component will always be attached to the pot magnet in its correct position. Moreover, the jointing aids make it impossible for the pot magnet to change its position in the case component during loudspeaker operation.

EMBODIMENTS OF THE INVENTION

The invention will now be described in greater detail with the help of a possible embodiment.

Figure 1:
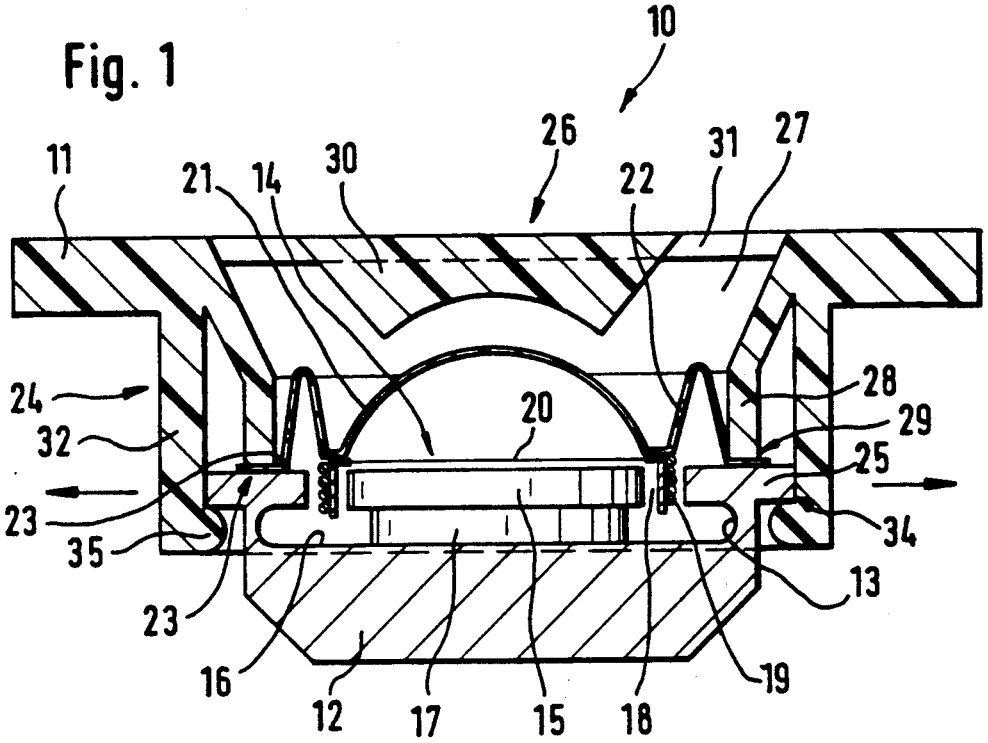
FIG. 1 shows a section through a calotte-type treble loudspeaker in side elevation

The outline of the calotte-type treble loudspeaker 10 shown in FIG. 1 is to all intents and purposes constituted by the single-piece case component 11, which is made of a plastic material, and the pot magnet 12.

A pole core 14 is arranged in the interior of the pot magnet 12 in such a way as to be concentric with respect to the central axis of the loudspeaker 10 and to leave a certain distance between itself and the internal surface 13 of the pot magnet 12. This pole core 14 is made up of an upper pole plate 15 and a disk 17 interposed between the said pole plate 15 and the bottom 16 of the pot magnet 12. The disk 17 is made of a high-energy magnetic material. The moving coil 19 projects into the gap 18 between the pole core 14 and the internal surface 13 of the pot magnet 12. The circumference 20 of the moving coil 19 facing away from the bottom 16 of the pot magnet 12 is attached to a membrane 21 that has the shape of a semi-sphere and therefore covers the pole core 14. In the embodiment here considered the outer circumference of the membrane is surrounded by a wave-shaped edge, the socalled centering membrane 22, where the outer edge of the said centering membrane 22 bears against the edge 23 of the pot magnet 12. This centering membrane 22 has the task of accurately centering the moving coil 19 within the gap 18 between the pole core 14 and the inner surface 13 of the pot magnet. The membrane 21 and the centering membrane 22 are made of a plastic foil and constitute a single piece. The side of the pot magnet 12 facing away from its bottom 16, together with the membrane 21 and the centering membrane 22, is covered by a case component 11 shaped more or less in the manner of a pot, where the side wall 24 of the case component envelops a circumferential collar 25 arranged on the outer surface of the pot magnet 12. The lid 26 of the case component 11 is provided with a sound exit opening 27 opposite the membrane 21. This opening is conical in section and has its larger diameter on the side facing away from the pot magnet 12. Attached to the edge of the conical opening 27 having the smaller diameter there is a piece of tubing 28, which is again concentric with respect to the central axis of the loudspeaker and so arranged that its free end 29 bears against the edge 23 of the pot magnet 12 when the case component 11 is attached to the said pot magnet 12. It is particularly advantageous when the centering membrane 22 is provided with a circumferential flange that will be pressed against the upper edge 23 of the pot magnet 12 by the free end 29 of the piece of tubing 28 when the case component 11 and the pot magnet 12 are joined together. In that case there is no need to provide for a special attachment of the centering membrane 22 to the edge 23 of the pot magnet 12. If, over and above this, the inner diameter of the piece of tubing 28 and the outer diameter and the side slope of the wave-shaped centering membrane 22 are properly matched to each other, the connection of the pot magnet 12 and the case component 11 becomes further simplified, because in that case mere insertion of the centering membrane 22 and the membrane 21 attached to it, together with the moving coil 19, already has the effect of ensuring that the said membrane 21 and the said membrane 19 will be correctly positioned in the gap 18 between the pot magnet 12 and the pole core 14.

An acoustic equalizer 30 is arranged in a central position within the sound exit opening 27 and maintained there by means of the webs 31 that connect it to the edge of the opening 27.

Figure 3:
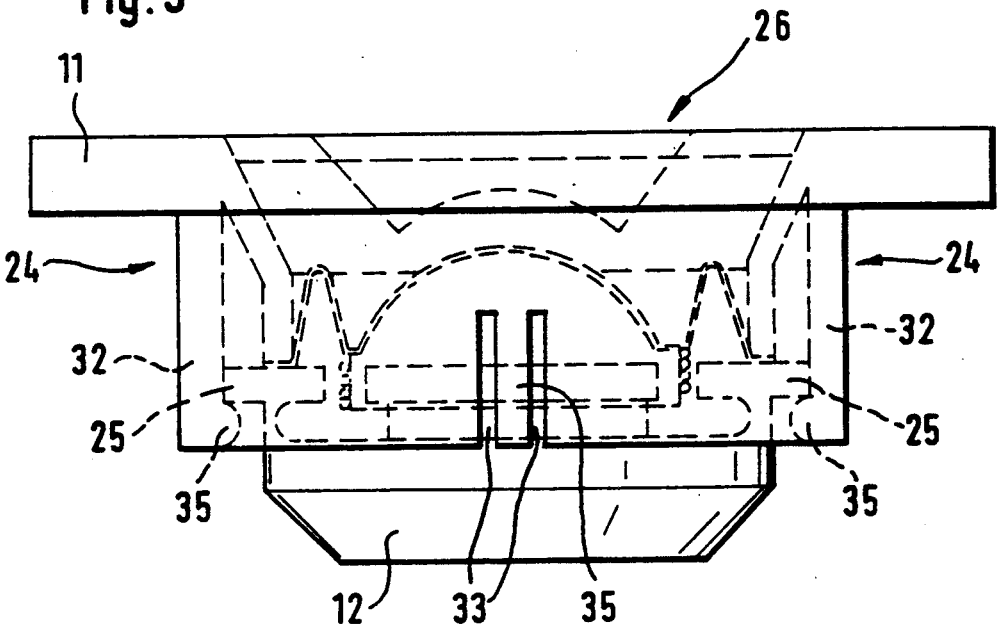
FIG. 3 shows a side elevation of a calotte-type treble loudspeaker.

The case component side wall 24, which envelops a part of the outer jacket of the pot magnet 12, is provided with several elastic snap catches 32. As is made clear by FIG. 3, these snap catches are formed by means of two parallel slits 33 arranged in the side wall and running in the direction of the lid 26. The free end 34 of these snap catches is provided with a locking hook 35. When the pot magnet 12 is pressed into the case component 11, which at that moment already has the centering membrane 22, the membrane 21 and the moving coil 19 inserted into it, the collar 25 arranged on the outer surface of the pot magnet 12 will cause the snap catches to deflect elastically, i.e. to move in the direction of the arrows, as the pot magnet is pressed home in the direction of the sound exit opening 27. Since the distance between the free end 29 of the piece of tubing 28 and the rim of the locking hook 35 is made equal to the thickness of the collar 25, the catches 32 will snap back into their rest position, moving in the direction opposite to the arrows, as soon as the edge 23 of the pot magnet 12 comes to bear against the free end 29 of the piece of tubing 28. This causes the locking hooks 35 to engage with the collar 25, thereby joining the two components to each other. The joining of the pot magnet 12 and the case component 11 will be facilitated when both the collar 25 and the locking hooks 35 are given a slightly rounded form as shown in FIG. 1.

Figure 2:
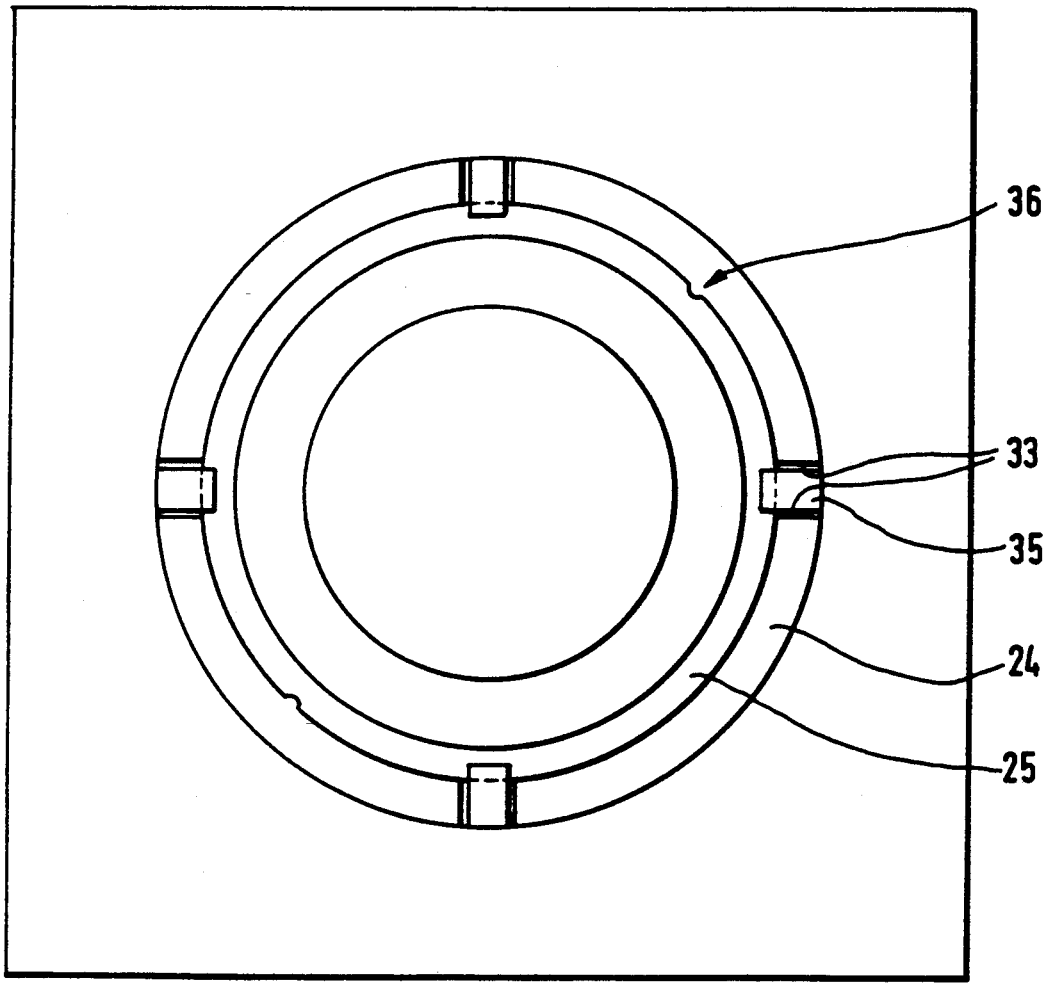
FIG. 2 shows a top view of a calotte-type treble loudspeaker as shown in FIG. 1.

Should the inner surface of case component side wall 24 prove insufficient to guide the pot magnet when the two parts are joined together, appropriate jointing or alignment aids 36 running parallel to the central axis of the loudspeaker 10 can be arranged on the collar 25 and on the inner surface of the case component side wall 24, all as shown in FIG. 2. The particular alignment aids 36 shown in FIG. 2 are intended only as an example. When such alignment aids 36 are provided, the position of the pot magnet 12 within the case component 11 remains fixed also as far as rotary movements are concerned.

Lastly, it should here be added that the contacting details of the moving coil have not been shown in the illustrations of the loudspeaker 10.

We claim:

1. A loudspeaker (10) comprising a pot magnet (12); a pole core (14) comprising an upper pole plate (15) and a highly energized disk (17) arranged between the upper pole plate (15) and a bottom (16) of the pot magnet (12), said pole core being arranged concentrically inside the pot magnet (12) and at a certain distance (18) from an inner face thereof; a one-piece membrance (21) having a central semispherical portion, a peripheral part designed to act as a centering portion; a moving coil (19) that is attached to the membrance (21) in a transition area between the centering portion (22) and said semispherical portion, said moving coil having a free end that projects into the gap (18) between the inner face of the pot magnet (12) and the pole core (14); and a single-piece case component (11) that covers both the semispherical portion of the membrance (21) and the centering portion (22), said case component being provided with acoustic equalizers (30) opposite said semispherical portion, and said case component being connected to the pot magnet (12), the diameter of the moving coil (19) is less than 19 mm, the single-piece case component (11) is connected to the pot magnet (12) exclusively by means of elastic snap catches (32) arranged on the side wall (24) of the case component, where locking hooks (35) forming an integral part of said snap catches (32) engage with a collar (25) arranged on the outer surface of the pot magnet (12), and the single-piece membrance (21), once the case component (11) has been locked to the pot magnet (12), is maintained in its position between the case component (11) and the pot magnet (12) solely and exclusively by virtue of the fact that a part of the membrance (21) is pressed against said pot magnet (12) by a free end (29) of a piece of tubing (28) arranged on said case component (11).

2. A loudspeaker in accordance with claim 1, characterized in that alignment aids (36) are arranged on the outer surface of the pot magnet (12) and the inner surface of the case component (11) in the area in which said surfaces overlap.

* * * * *